US007045727B2

(12) United States Patent
Chiang et al.

(10) Patent No.: US 7,045,727 B2
(45) Date of Patent: May 16, 2006

(54) SOCKET ASSEMBLY WITH A CORD SORTER

(75) Inventors: Yi-Te Chiang, Taipei (TW); Hsueh-Lan Lin, Pan Chiao (TW)

(73) Assignee: Primax Electronics Ltd., Taipei (TW)

( * ) Notice: Subject to any disclaimer, the term of this patent is extended or adjusted under 35 U.S.C. 154(b) by 147 days.

(21) Appl. No.: 10/673,366

(22) Filed: Sep. 30, 2003

(65) Prior Publication Data

US 2004/0251118 A1 Dec. 16, 2004

(30) Foreign Application Priority Data

Jun. 13, 2003 (CN) ..... 03 1 41063

(51) Int. Cl.
*H01H 29/16* (2006.01)

(52) U.S. Cl. ..... 200/200; 439/585; 439/620; 439/906

(58) Field of Classification Search ..... 439/585–603, 439/620, 842, 904–906
See application file for complete search history.

(56) References Cited

U.S. PATENT DOCUMENTS

| | | | | |
|---|---|---|---|---|
| 4,017,141 | A * | 4/1977 | Bury et al. | 439/596 |
| 4,767,361 | A * | 8/1988 | Hoshino et al. | 439/596 |
| 4,984,982 | A * | 1/1991 | Brownlie et al. | 439/131 |
| 5,122,081 | A * | 6/1992 | Bogiel et al. | 439/596 |
| 5,605,466 | A * | 2/1997 | Devlin et al. | 439/144 |

* cited by examiner

*Primary Examiner*—K. Lee
(74) *Attorney, Agent, or Firm*—Troxell Law Office, PLLC

(57) ABSTRACT

A socket assembly with a cord sorter includes a multi-socket unit and a sorter. The multi-socket unit provides a plurality of sockets for engaging with respective plugs leading respective cords. The sorter is used to provide a gathering structure for collect the cords in order and thus can make the cords easy to be managed.

5 Claims, 10 Drawing Sheets

SOCKET ASSEMBLY WITH A CORD SORTER

BACKGROUND OF THE INVENTION

1. Field of the Invention

The invention relates to a communication socket assembly having a plurality of sockets, and more particularly to an assembly which is equipped with a sorter for collecting cords.

2. Description of the Prior Art

In the information age, the knowledge or information flow does highly depend on networking, which includes existing telnet, cable net and fiber net. Typically, taking a telnet for example, the telnet reaches individual family by a form of a wall plate having at least a receiving communication socket constructed on an interior wall. The wall plate is then performed as a terminal of the far-side telnet for domestic extension usage.

Referring now to FIG. 1A, a conventional wall socket plate 10 with a plurality of communication sockets 14 (five communication sockets shown) is shown perspective. The wall socket plate 10 includes a panel plate 12 for constructing the communication sockets 14. Several screws 16 (two shown in the figure) can be used to mount the wall socket plate 10 onto a wall or a floor (not shown in the figure). Inside each of the communication sockets 14, a predetermined number of gold-plated contacts 18 are included to perform as terminals of a foreign net (not shown in the figure).

Referring now to FIG. 1B, every communication socket 14 in the wall socket plate 10 of FIG. 1A is engaged with a respective plug 60 as an end of a respective cords 62 which has another end connected with a communication equipment; say, a telephone or a computer for example. Obviously, the wall socket plate 10 having 5 communication sockets 14 shown in FIG. 1A or FIG. 1B can engage maximally and parallel with 5 plugs 60, i.e. 5 local communication equipments, at the same time.

Referring now to FIG. 2, a conventional extension split adaptor 20 is shown explodedly. The extension split adaptor 20 includes a housing 21 for accommodating a socket panel 22 forming a plurality of sockets. One end of the socket panel 22 provides openings of the sockets for receiving plugs while another end thereof is wiring in parallel by an extension cord 23 to a plug 24.

In general, a conventional wall socket plate usually mounted to an interior wall can only provide a limited number of communication sockets, one or two mostly. Therefore, only a limited number of local communication equipments can be connected with the foreign net. Definitely, such a situation has be improved by utilizing the extension split adaptor, as the one 20 shown in FIG. 2 for example, to each communication socket of the wall socket plate.

Nevertheless, no matter what kind of efforts is introduced to resolved the foregoing problem, an identical situation rises to bother the simultaneous application of multiple sockets. The situation is the problem of messing-up cords close to the sockets, from which the cord and plug particular to an interested equipment will be hard to be identified and thus work upon sorting the cords will become both tedious and trivial.

Therefore, a resort to overcome the aforesaid problem of messing-up cords is welcome definitely in the art.

SUMMARY OF THE INVENTION

Accordingly, it is a primary object of the present invention to provide a socket assembly with a cord sorter which the sorter can put cords of plugs engaged with respective sockets in parallel in order and thereby resolve the messing-up problem for cords close to the socket assembly.

The socket assembly with a cord sorter in accordance with the present invention can include a multi-socket unit and a sorter. A front end of the multi-socket unit is used to construct a plurality of sockets while an opposing rear end is used for further engagement. Inside each socket, a plurality of gold-plated contacts are included for forming a terminal of a foreign net.

The sorter of the present invention can include a gathering structure located at the front end of the multi-socket unit. In the case that the sockets engages with the respective plugs, the gathering structure can then be used to collect the respective cords in a predetermined order.

All these objects are achieved by the socket assembly with a cord sorter described below.

BRIEF DESCRIPTION OF THE DRAWINGS

The present invention will now be specified with reference to its preferred embodiment illustrated in the drawings, in which.

DESCRIPTION OF THE PREFERRED EMBODIMENT

The invention disclosed herein is directed to a socket assembly with a cord sorter. In the following description, numerous details are set forth in order to provide a thorough understanding of the present invention. It will be appreciated by one skilled in the art that variations of these specific details are possible while still achieving the results of the present invention. In other instance, well-known components are not described in detail in order not to unnecessarily obscure the present invention.

Figure 3A:
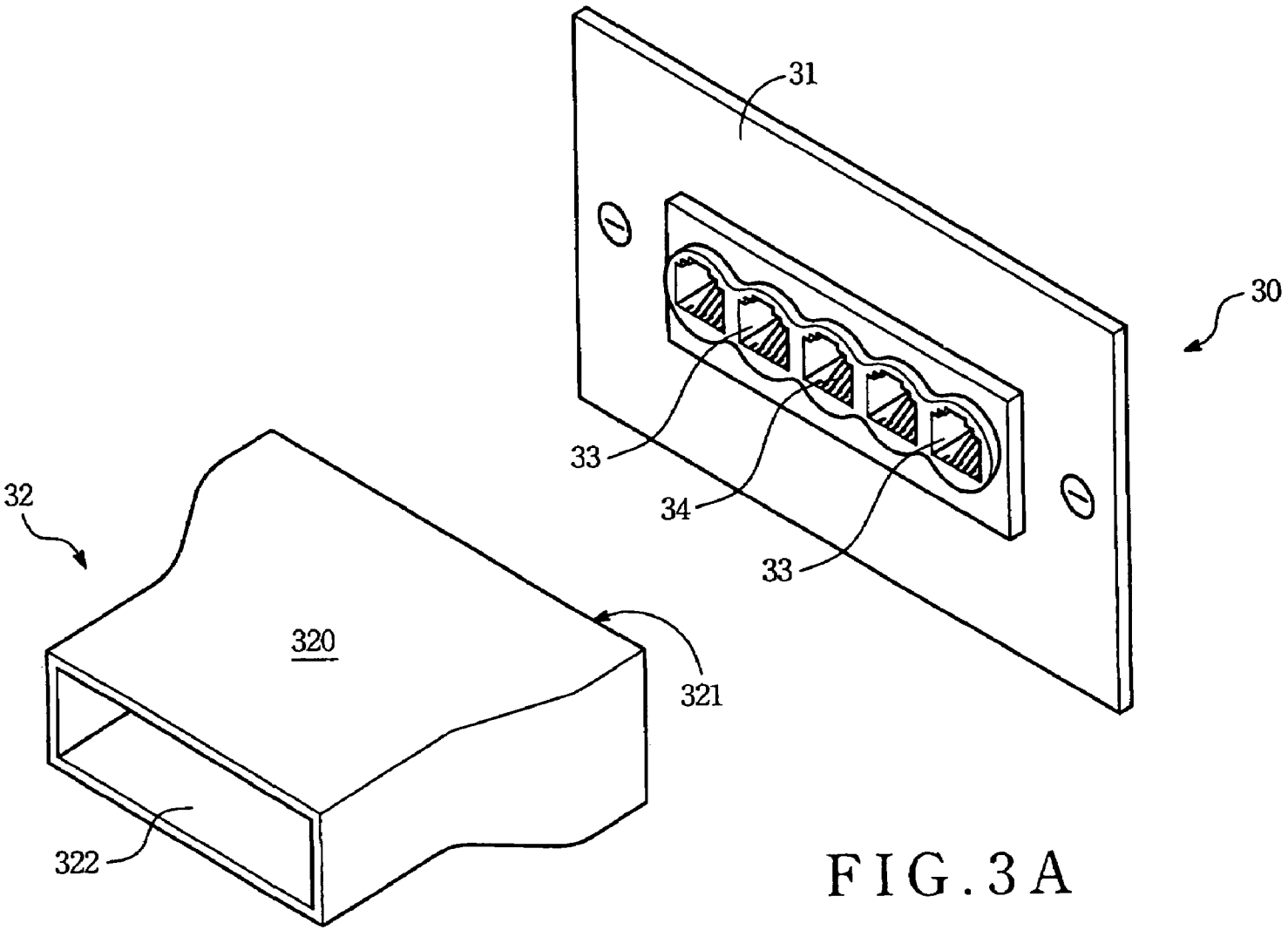
FIG. 3A is an exploded perspective view of a first embodiment of the socket assembly with a cord sorter in accordance with the present invention.

Referring now to FIG. 3A, an exploded view of a first embodiment of the socket assembly with a cord sorter according to the present invention is shown. The socket assembly 30 includes a multi-socket unit 31 formed as a wall socket plate described above and a sorter 32.

The multi-socket unit 31 has a front end thereof to construct a plurality of sockets 33 while an opposing rear end thereof is used to be fixed to a wall or a floor. Inside each of the sockets 33, a plurality of gold-plated contacts 34 are included for forming a signal terminal of a foreign net which is introduced through the wall or the floor where the multi-socket unit 31 mounts.

The sorter 32 of this embodiment is a gathering structure which includes a hollow shell 320 having a first opening 321 and an opposing second opening 322. The first opening 321 can engage with the multi-socket unit 31. Typically, the second opening 322 is smaller in area than the first opening 321 so that a collecting or gathering effect upon the cords can be obtained.

Figure 3B:
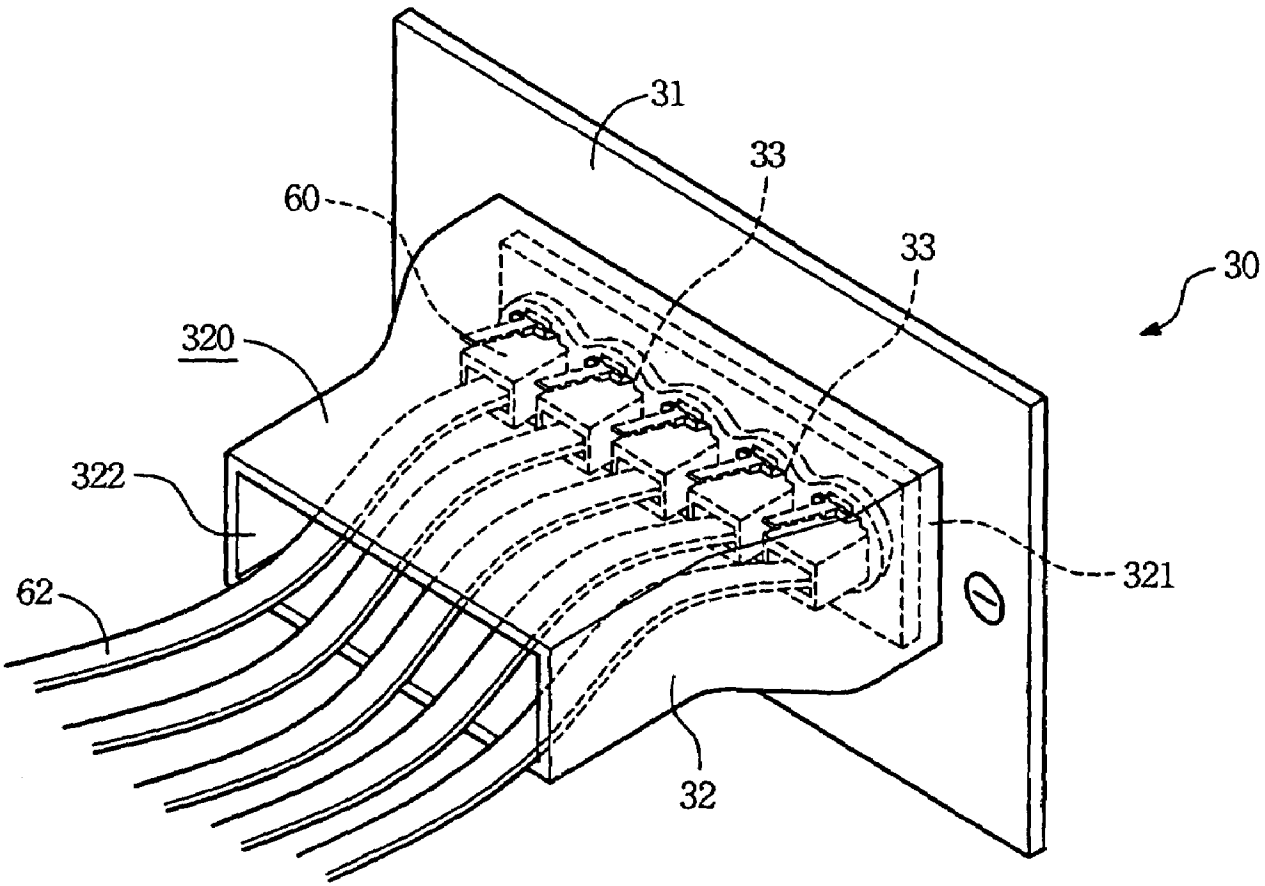
FIG. 3B shows an application state of FIG. 3A.

Referring now to FIG. 3B, in the case that the first embodiment 30 of the socket assembly with a cord sorter in accordance with the present invention is applied to receive a plurality of plugs 60 leading the cords 60, the plugs 60 as well as the cords 62 pass firstly through the sorter 32 from the second opening 322 of the hollow shell 320 and then engage with the respective sockets 33 via the first opening 321. The sorter 32 as shown is then, by the first opening 321, sleeved onto the multi-socket unit 31 by circling all of the sockets 33 and thereby the cords 62 can be gathered by the hollow shell 320. Upon such an arrangement, the cords 62 will never be messed up and the sockets 33 as well as the incoming plugs 60 can be shielded from possible particle contamination. That is to say that the hollow shell 320 of this embodiment can benefit to both cord-collection and dust-prevention.

Figure 4A:
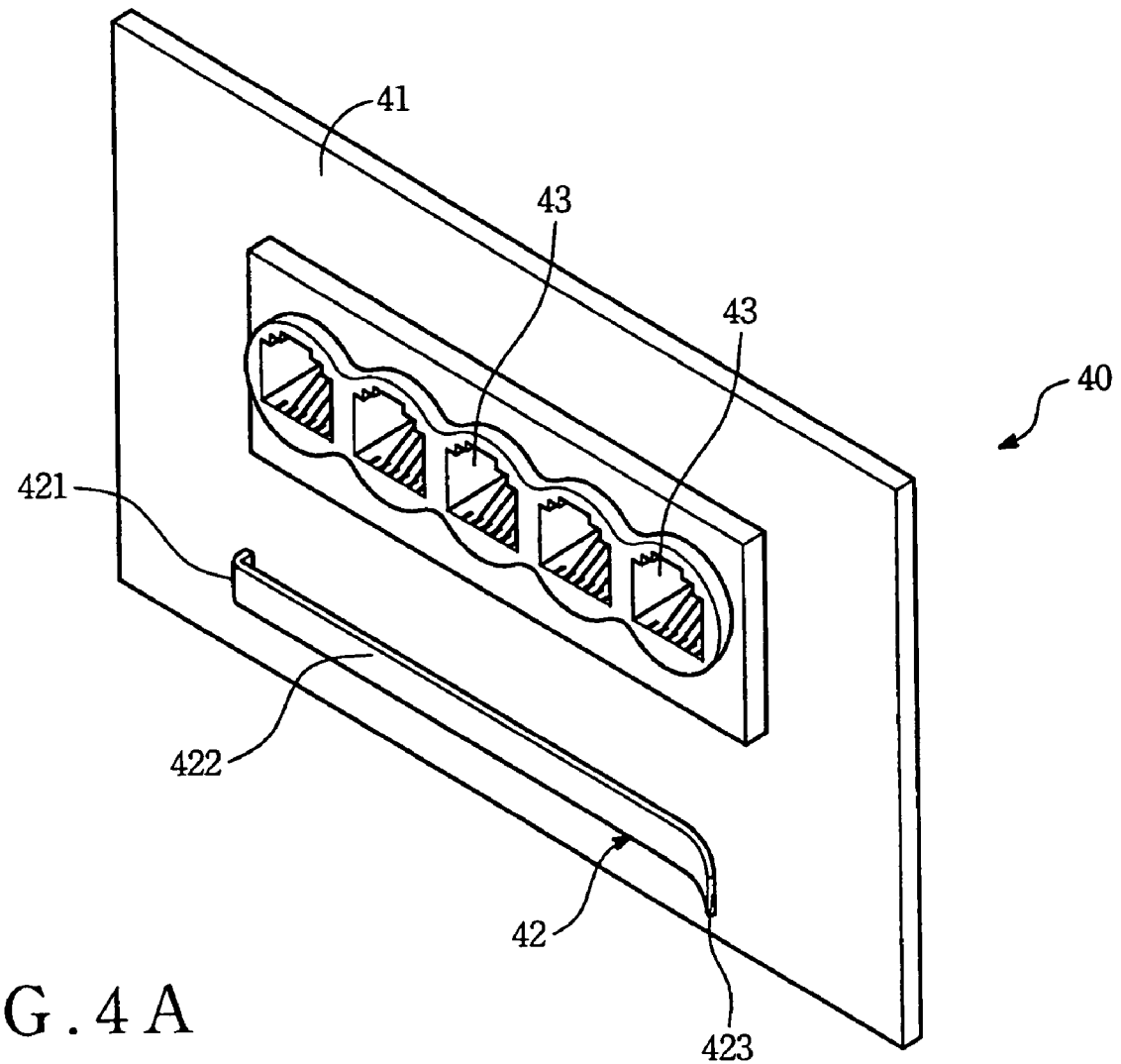
FIG. 4A is a perspective view of a second embodiment of the socket assembly with a cord sorter in accordance with the present invention.
Figure 4B:
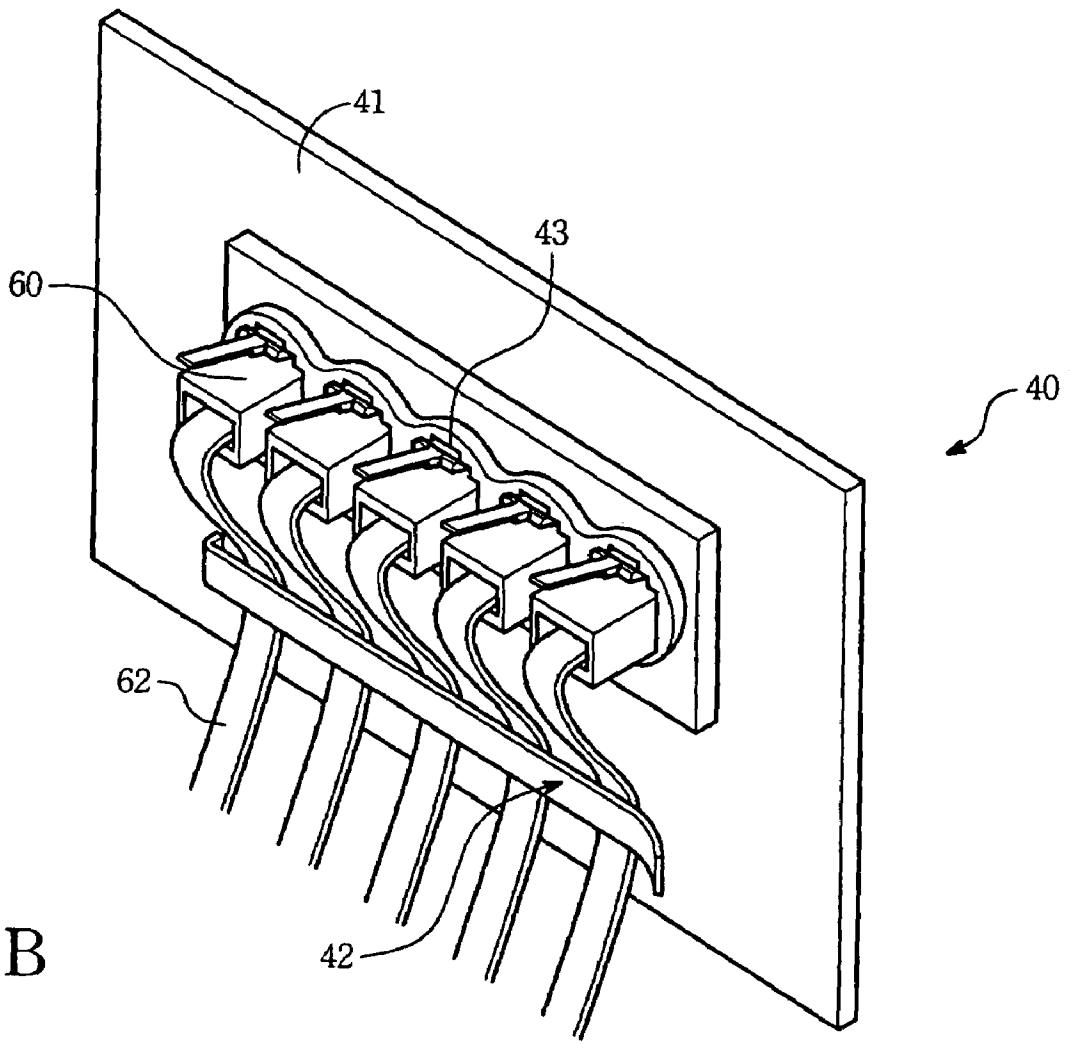
FIG. 4B shows an application state of FIG. 4A.

Referring now to FIG. 4A and FIG. 4B, a second embodiment 40 of the socket assembly with a cord sorter in accordance with the present invention is shown to have a multi-socket unit 41 and a sorter 42. The multi-socket unit 41 of this embodiment 40 is the same as that of the first embodiment 30 shown in FIG. 3A and FIG. 3B, and so detail description upon the multi-socket unit 41 will be omitted herein.

The sorter 42 of the second embodiment 40, profiled as a curved cantilever bar directly rooting at the multi-socket unit 41 of the socket assembly 40, can include a fixed end 421, a cantilever beam 422 and a free end 423. The fixed end 421 is fixed at a proper location on the multi-socket unit 41. The cantilever beam 422 as shown is almost parallel by a predetermined spacing to the multi-socket unit 41. Upon pulling the cantilever beam 422 away to make the free end 423 further separate to the multi-socket unit 41, cords 62 can then be arranged in order, from the free end 423 of the sorter 42, into the spacing between the cantilever beam 422 and the multi-socket unit 41. As soon as the sorter 42 is released, the cantilever beam 422 can then press the cords 62 to the multi-socket unit 41 and thus collects firmly the cords 62 between the cantilever beam 422 and the multi-socket unit 41.

Therefore, in the case that the socket assembly 40 of this second embodiment is used to engage more than one plugs 60, the plugs 60 are firstly introduced to the respective sockets 43 of the multi-socket unit 41 in order and, at the same time, the cords 62 are also collected into the space between the sorter 42 and the multi-socket unit 41 in order. Upon such an arrangement, the messing-up problem of the cords 62 can thus be avoided.

Figure 1A:
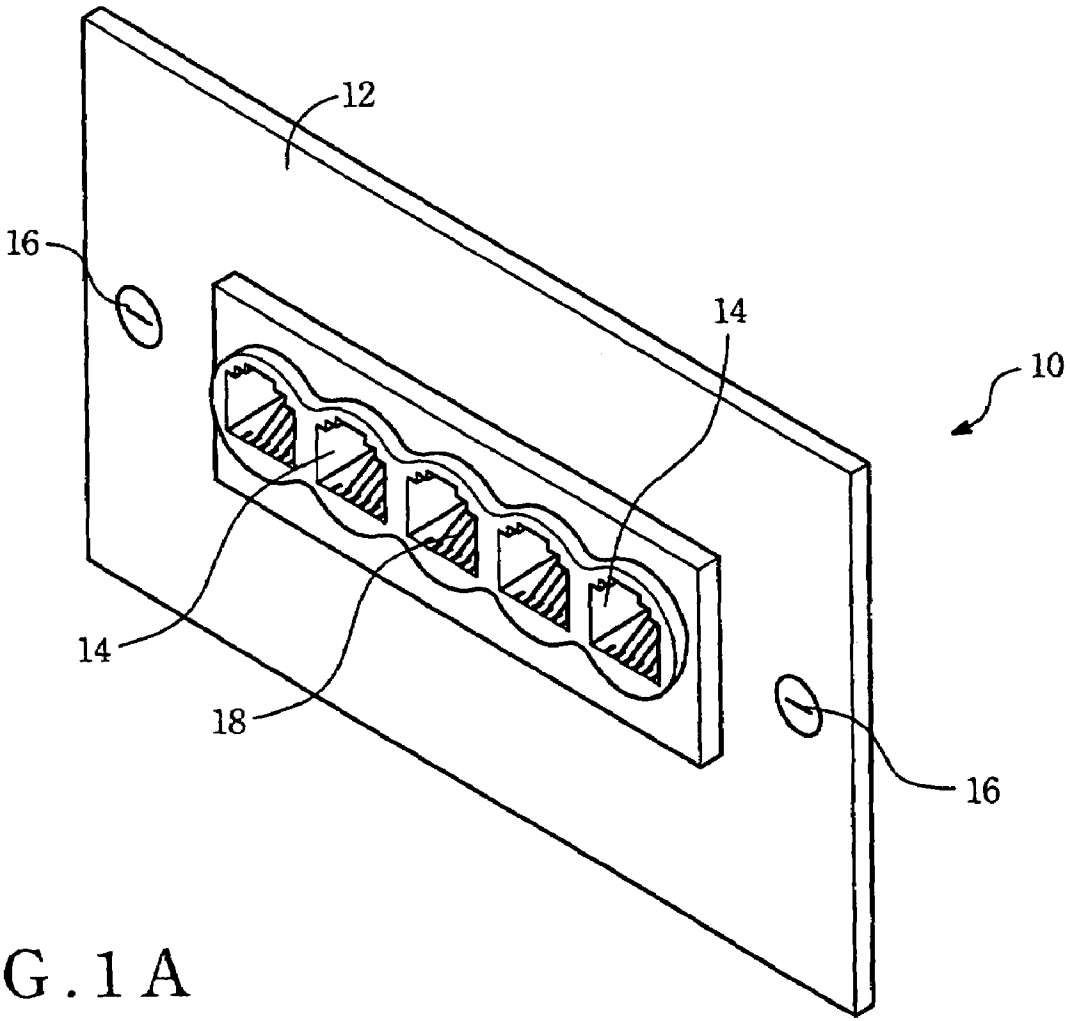
FIG. 1A (PRIOR ART)
FIG. 1A is a perspective view of a conventional wall socket plate.
Figure 1B:
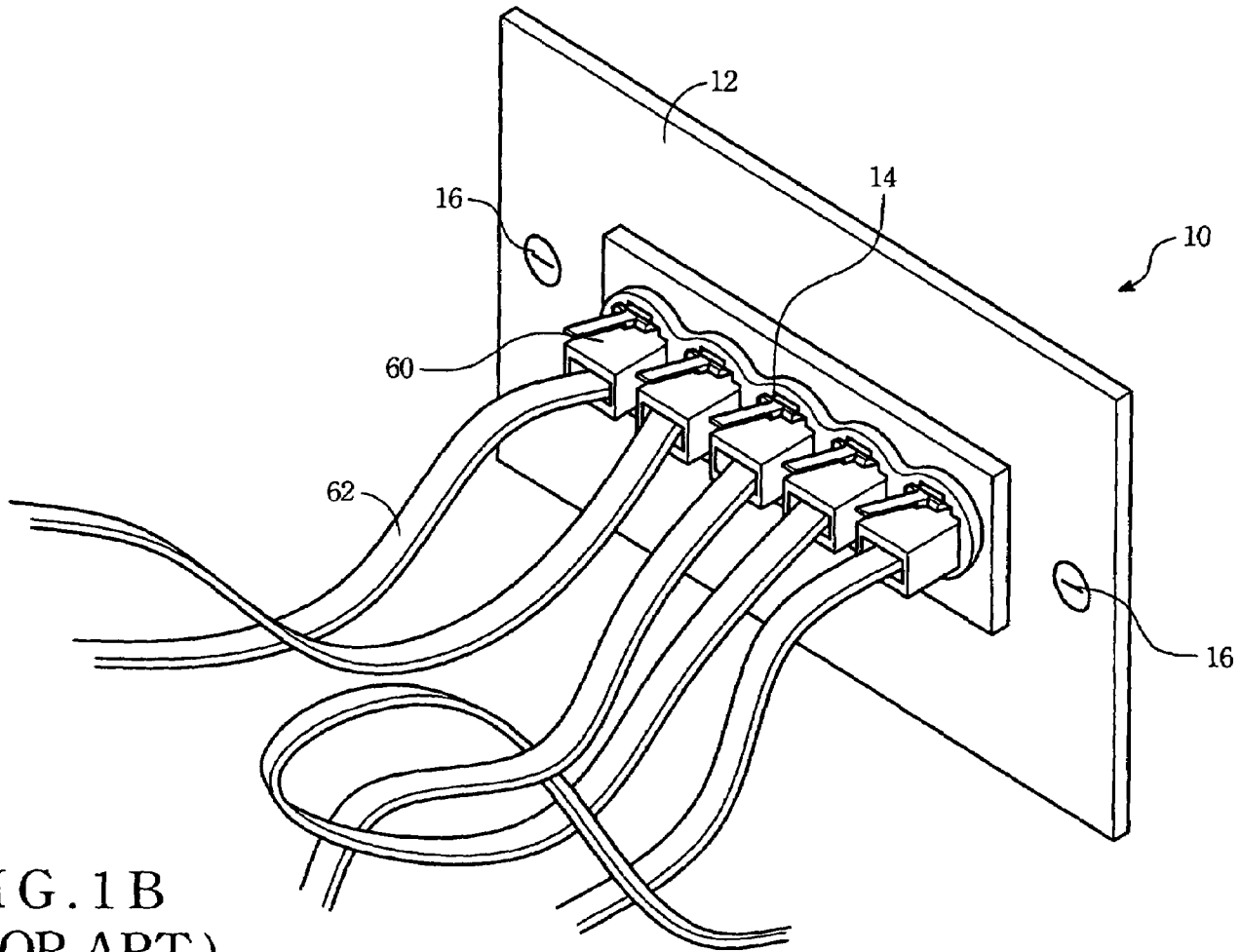
FIG. 1B (PRIOR ART)
FIG. 1B is an application of FIG. 1A showing a plurality of plugs introduced to respective communication sockets of the wall socket plate.
Figure 2:
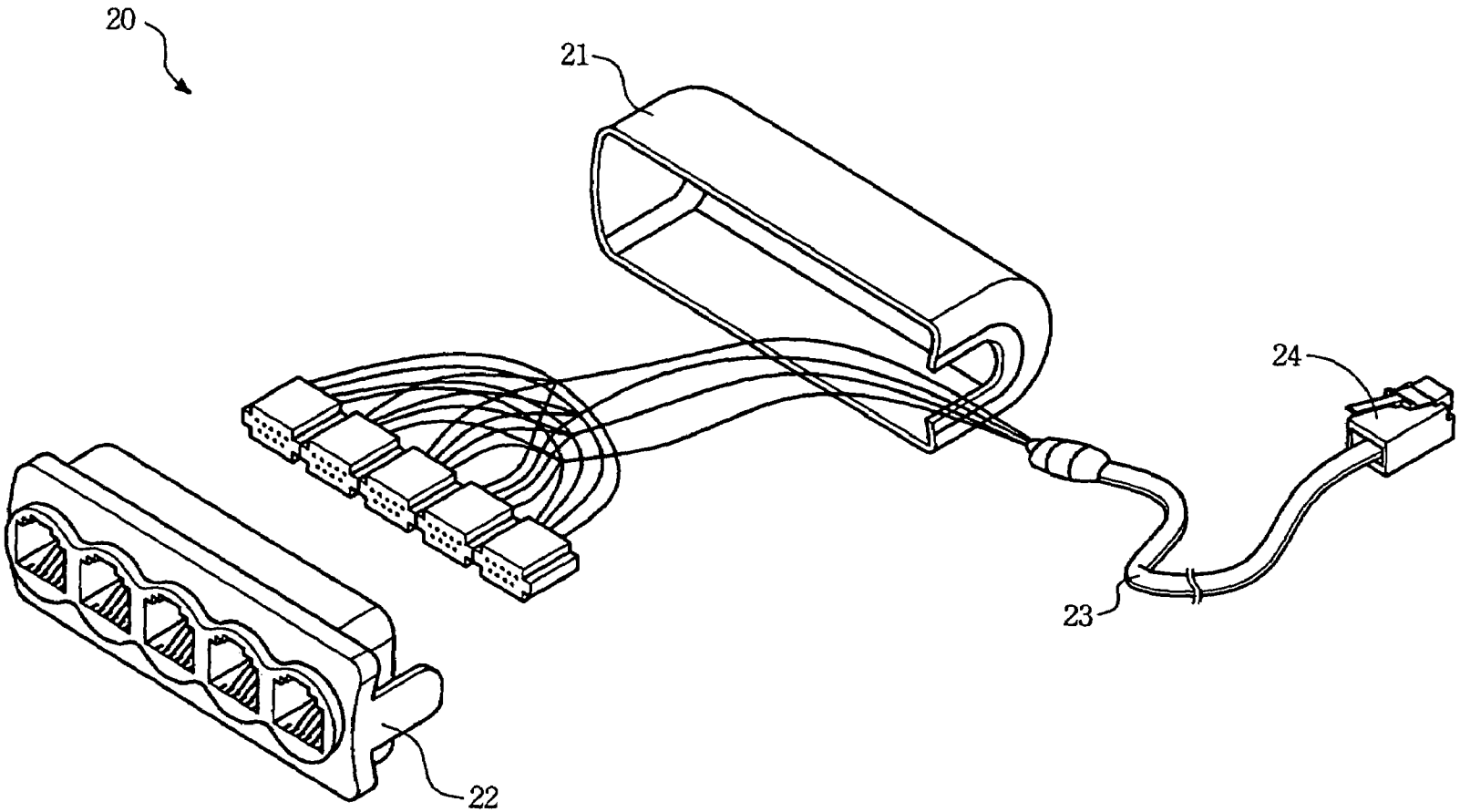
FIG. 2 (PRIOR ART)
FIG. 2 is an exploded perspective view of a conventional extension split adaptor.

It is noted that the first and the second embodiments of the present invention described above are the embodiments that apply the sorter to a multi-socket unit formed as a wall socket plate like the one shown in FIG. 1A or FIG. 1B. Yet, the teaching of the present invention can also be adopted to the extension split adaptor shown in FIG. 2.

Figure 5A:
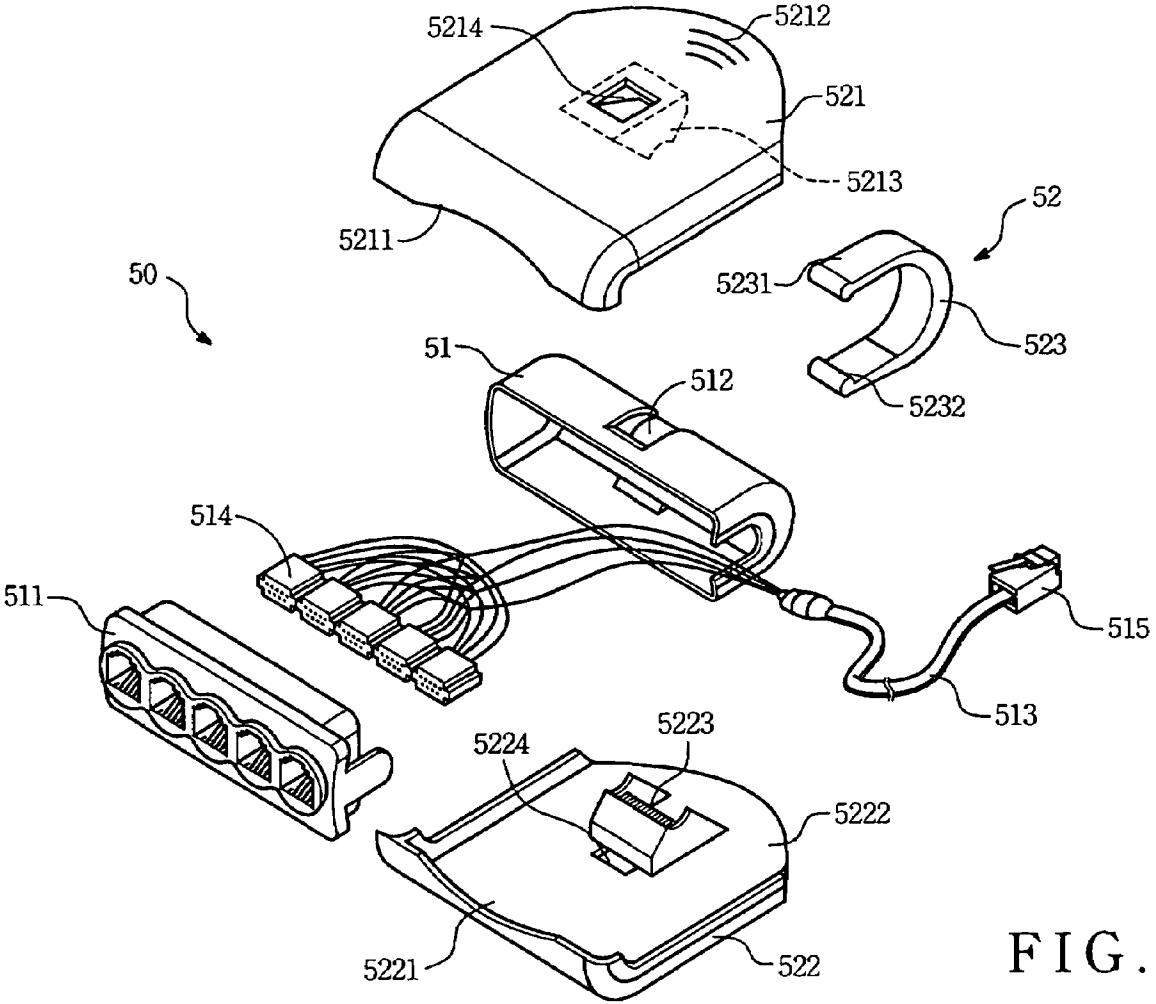
FIG. 5A, is an exploded perspective view of a third embodiment of the socket assembly with a cord sorter in accordance with the present invention.

Referring now to FIG. 5A, a third embodiment 50 of the socket assembly with a cord sorter in accordance with the present invention is shown explodedly. The socket assembly 50 includes a multi-socket unit 51 formed similarly as an extension split adaptor described in FIG. 2 and a sorter 52. The multi-socket unit 51 has its front end formed as a socket panel 511 while the rear end thereof is constructed to have a pivotal shaft 512. As shown, the multi-socket unit 51 can utilize an extension cord 513 and a leading plug 515 to reach a communication socket of a foreign net. Also, another end of the extension cord 513 is profiled to form a parallel socket base 514 for being inserted into the socket panel 511.

The sorter 52 of the third embodiment can include an upper-half shield 521, a lower-half shield 522 and an elastic element 523 (formed preferably as a U-shaped clip in this embodiment). The upper-half shield 521 has an upper-half opening 5211 at a front end, an upper depressed end 5212 at an opposing rear end, an upper arch sleeve 5213 and an upper aperture 5214 at a bottom surface between the upper-half opening 5211 and the upper depressed end 5212. The upper arch sleeve 5213 can form a rotational pair with a pivotal shaft 512 of the multi-socket unit 51. On the other hand, the lower-half shield 522 has a lower-half opening 5221 at a front end, a lower depressed end 5222 at an opposing rear end, a lower arch sleeve 5223 and a lower aperture 5224 at an upper surface between the lower-half opening 5221 and the lower depressed end 5222. The lower arch sleeve 5223 can form another rotational pair with the pivotal shaft 512 of the multi-socket unit 51. The elastic element 523 which can be U-shaped or V-shaped includes an upper arm 5231 for engaging with the upper aperture 5214 of the upper-half shield 521 and a lower arm 5232 for engaging with the lower aperture 5224 of the lower-half shield 522. By providing the elastic element 523, the upper-half shield 521, the lower-half shield 522 and the multi-socket unit 51 can be held firmly together and also a gathering structure is formed by pairing the upper-half opening 5211 and the lower-half opening 5221.

Figure 5B:
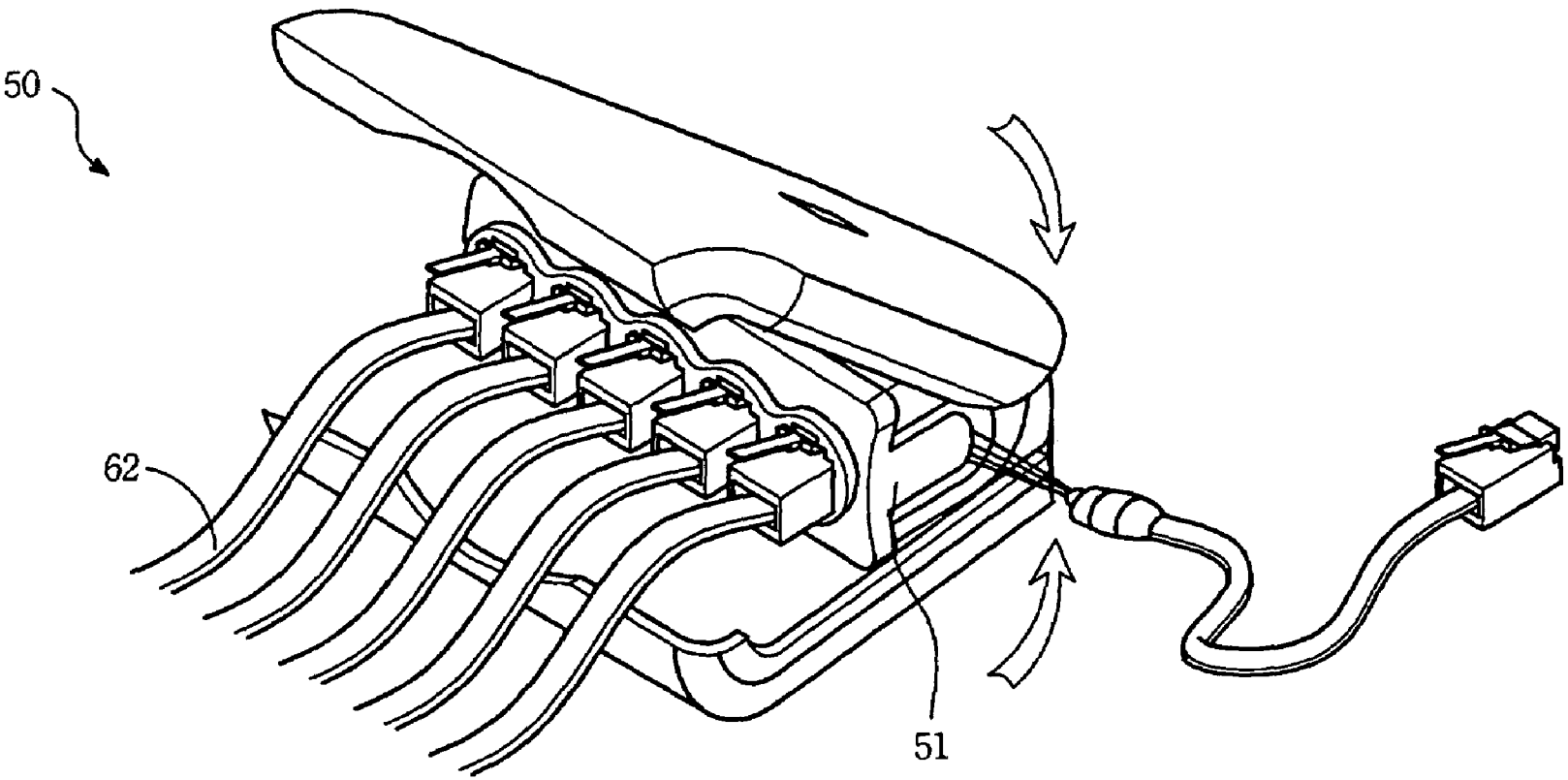
FIG. 5B shows an application state of FIG. 5A with the shield opened.
Figure 5C:
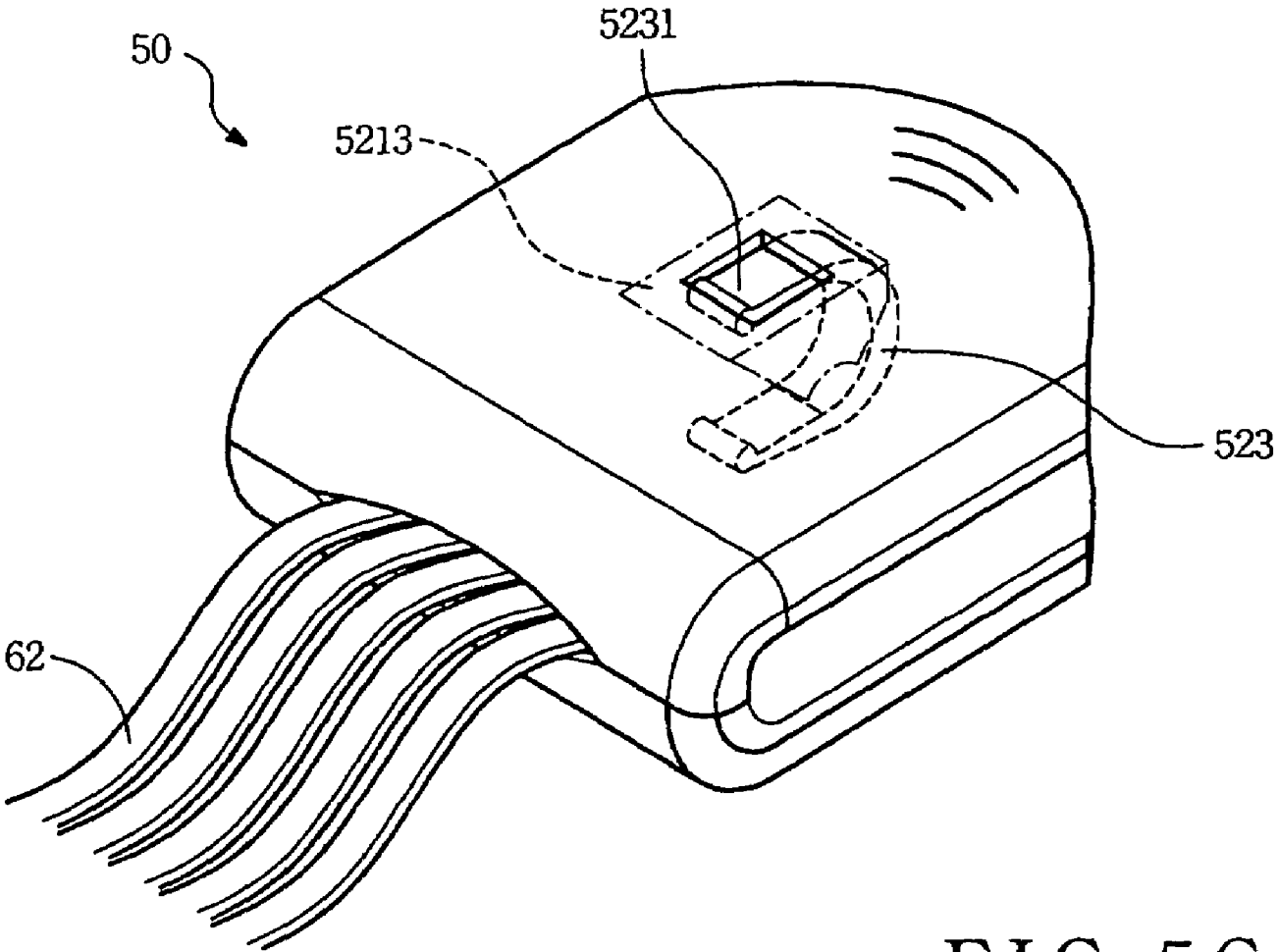
FIG. 5C is a perspective view of FIG. 5B with the shield closed.

Referring now to FIG. 5B and FIG. 5C, two application states of the third embodiment 50 of FIG. 5A are shown. As shown, a plurality of plugs 60 are introduced to engage with respective sockets of the multi-socket unit 51. Before the plugs 60 are to be anchored at the respective sockets, the upper-half shield 521 and the lower-half opening 522 are pressed together by depressing the upper depressed end 5212 and the lower depressed end 5222 so as to have the upper arch sleeve 5213 and the lower arch sleeve 5223 form respective rotational pairs with the pivotal shaft 512 of the multi-socket unit 51. At this time, the upper-half opening 5211 and the lower-half opening 5221 are separated and the elastic element 523 are expended (as shown in FIG. 5B). Under such a state, the plugs can be sent in order to engage with the respective sockets at the socket panel 511 of the multi-socket unit 51. After the engagement between the plugs 60 and the sockets is complete, the forcing to depress the upper depressed end 5212 and the lower depressed end 5222 can then be removed so as to have the elastic element 523 come into action and rotate the upper arch sleeve 5213 as well as the lower arch sleeve 5223 about the pivotal shaft 512 to make the upper-half opening 5211 and the lower-half opening 5221 closed to form a gather structure that can collect the cords 62 of the plugs 60. In addition, the housing formed by pairing the upper-half shield 521 and the lower-half shield 522 can prevent the multi-socket unit 51 from dust contamination.

Also, in foregoing embodiment of the present invention, though the elastic element 523 is preferably formed as a U-clip, yet to those skilled in the art should understand that the elastic element 523 of the present invention is simply targeted to a means for providing elasticity to connect the upper-half shield 521 and the lower-half shield 522. Therefore, various variations for the elastic element 523 in form other than the U-clip are still within the scope of the present invention.

While the present invention has been particularly shown and described with reference to a preferred embodiment, it will be understood by those skilled in the art that various changes in form and detail may be without departing from the spirit and scope of the present invention.

The invention claimed is:

1. A socket assembly with a cord sorter, comprising:

a multi-socket unit, having thereof a front end further including a plurality of sockets, each of said sockets capable of receiving a plug leading a cord; and a sorter, having a gathering structure constructed at said front end of said multi-socket unit for collecting cords of plugs engaging with said sockets, wherein said multi-socket unit further including a rear end opposing to said front end, said rear end further including a pivotal shaft, wherein said sorter further comprising:

an upper-half shield, having an upper-half opening at a front end thereof, an upper depressed end at an opposing rear end thereof, and an upper arch sleeve and an upper aperture at a bottom surface between said upper-half opening and said upper depressed end, said upper arch sleeve capable of forming a rotational pair with said pivotal shaft of said multi-socket unit;

a lower-half shield, having a lower-half opening at a front end thereof, a lower depressed end at an opposing rear end thereof, and a lower arch sleeve and a lower aperture at an upper surface between said lower-half opening and said lower depressed end, said lower arch sleeve capable of forming another rotational pair with said pivotal shaft of said multi-socket unit; and an elastic element, further including an upper arm for engaging with said upper aperture of said upper-half shield and a lower arm for engaging with said lower aperture of said lower half shield.

2. A socket assembly with a cord sorter, comprising:

a multi-socket unit, having thereof a front end including a plurality of sockets and an opposing end including a pivotal shaft, each of said sockets capable of receiving a plug leading a cord; and a sorter, further including:

an upper-half shield, having an upper-half opening at a front end thereof, forming a rotational pair with said pivotal shaft of said multi-socket unit;

a lower-half shield, having a lower-half opening at a front end thereof, forming another rotational pair with said pivotal shaft of said multi-socket unit; and an elastic element, further including an upper arm for engaging with said upper aperture of said upper-half shield and a lower arm for engaging with said lower aperture of said lower-half shield;

wherein said elastic element integrates said upper-half opening and said lower-half opening to form a gathering structure capable of collecting said cords of said plugs in order.

3. The socket assembly with a cord sorter according to claim 2, wherein said upper-half shield further has an upper depressed end located at a rear end opposing to said front end of said upper-half shield, said lower-half shield further has a lower depressed end located at a rear end opposing to said front end of said lower-half shield; in the case of said upper depressed end and said lower depressed end being depressed, said upper-half opening and said lower-half opening being separated; in the case of said upper depressed end and said lower depressed end being released, said upper-half opening and said lower-half opening being closed to form said gathering structure.

4. The socket assembly with a cord sorter according to claim 2, wherein said upper-half shield further includes an upper arch sleeve and said lower-half shield further includes a lower arch sleeve, said upper arch sleeve pairing said pivotal shaft to form a rotational pair, said lower arch sleeve pairing said pivotal shaft to form another rotational pair.

5. The socket assembly with a cord sorter according to claim 2, wherein said upper-half shield further includes an upper aperture to engage with said upper arm of said elastic element and said lower-half shield further includes a lower aperture to engage with said lower arm of said elastic element.

* * * * *